US006163658A

United States Patent [19]

Suzuki

[11] Patent Number: 6,163,658

[45] **Date of Patent: *Dec. 19, 2000**

[54] PROCESS CARTRIDGE FOR STORING COMPRESSED INFORMATION DETACHABLY MOUNTABLE TO A MAIN ASSEMBLY OF AN IMAGE FORMING APPARATUS, AND AN IMAGE FORMING APPARATUS INCLUDING SUCH CARTRIDGE

[75] Inventor: Jun Suzuki, Numazu, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/780,685

[22] Filed: Jan. 8, 1997

[30] Foreign Application Priority Data

Jan. 9, 1996 [JP] Japan ..... 8-018090

[51] Int. Cl.[7] ..... G03L 15/00

[52] U.S. Cl. ..... 399/12; 399/81; 399/111

[58] Field of Search ..... 399/12, 24, 25, 399/81

[56] References Cited

U.S. PATENT DOCUMENTS

| | | | |
|---|---|---|---|
| 4,961,088 | 10/1990 | Gilliland et al. | 399/25 |
| 5,272,503 | 12/1993 | LeSueur et al. | 399/25 |
| 5,579,088 | 11/1996 | Ko | 399/12 |
| 5,696,605 | 12/1997 | Miller et al. | 358/468 |
| 5,699,091 | 12/1997 | Bullock et al. | 347/19 |

FOREIGN PATENT DOCUMENTS

| | | |
|---|---|---|
| 0438160A2 | 7/1991 | European Pat. Off. . |
| 0532308A2 | 3/1993 | European Pat. Off. . |
| 59-61854 | 4/1984 | Japan . |
| 6-149051 | 5/1994 | Japan . |
| 2234467 | 2/1991 | United Kingdom . |

OTHER PUBLICATIONS

Pat. Abs. Jap., vol. 095, No. 010, Nov. 1995 (JP 07 175370).

Pat. Abs. Jap., vol. 016, No. 009 (P–1296) Jan. 1992 (JP 03 230172).

*Primary Examiner*—Joan Pendegrass
*Attorney, Agent, or Firm*—Fitzpatrick, Cella, Harper & Scinto

[57] ABSTRACT

A process cartridge detachably mountable to a main assembly of an image forming apparatus includes an image bearing member; and a storing device for storing information which a user inputs using an input device of the main assembly of the image forming apparatus, or an external device connected to the main assembly of the image forming apparatus.

13 Claims, 14 Drawing Sheets

PROCESS CARTRIDGE FOR STORING COMPRESSED INFORMATION DETACHABLY MOUNTABLE TO A MAIN ASSEMBLY OF AN IMAGE FORMING APPARATUS, AND AN IMAGE FORMING APPARATUS INCLUDING SUCH CARTRIDGE

FIELD OF THE INVENTION AND RELATED ART

The present invention relates to an image forming apparatus such as a printer which employs an electrophotographic technology In particular, it relates to an image forming apparatus employing a cartridge system in which a photosensitive member, a charging member, a developing device, and the like are integrally united in the form of a cartridge removably mountable in the main assembly of an image forming apparatus, and also relates to such a cartridge.

In an image forming apparatus such as the one described above, a charging means for uniformly charging a photosensitive drum, an exposing apparatus for forming an electrostatic latent image on the photosensitive drum, a development apparatus for developing the electrostatic image into a visible image, a transfer apparatus for transferring the visible image onto a transfer material as recording medium, and a cleaning means for removing the toner remaining on the photosensitive member are disposed around the photosensitive drum, which is an electrophotographic photosensitive member. Also the image forming apparatus comprises a fixing apparatus for fixing the transferred visible image to the recording medium.

In a typical process cartridge, the photosensitive drum, the charging means, the development apparatus, and the cleaning apparatus are integrated into a unit removably mountable in the main assembly of an image forming apparatus.

With the provision of the above described general structure, the electrostatic latent image formed on the photosensitive drum by the exposing apparatus is visualized as a toner image by the developing apparatus, is transferred onto the recording medium by the transferring apparatus, and is conveyed to the fixing apparatus. In the fixing apparatus, the toner image is fixed to the recording medium. Thereafter, the recording medium is discharged out of the apparatus by a conveying means. The toner which was not transferred and are remaining on the photosensitive drum, is removed by a cleaning blade, and stored in a waste toner container.

Some process cartridges comprise a non-volatile RAM for storing information regarding the amount of the toner consumed by the main assembly of an image forming apparatus. This information is used to determine the usage limit of each process cartridge in order to inform a user of cartridge replacement timing. Such a process cartridge is described in Japanese Laid-Open Patent Application No. 61854/1984. Further, the non-volatile RAM provided in a process cartridge can afford an additional function such as protecting the apparatus. For example, a quality code may be stored in the non-volatile RAM to prevent an image forming operation from being carried out unless the quality code stored in a process cartridge matches the quality code on the apparatus main assembly side. Such a process cartridge is proposed in Japanese Laid-Open Patent Application No. 149051/1994.

However, in the process cartridges comprising the storage medium proposed in the above patent applications, the storage region is used only by a manufacturer to store information regarding apparatus management, quality control, process cartridge condition, or the like information predetermined by a manufacture. In other words, an actual user of a process cartridge or an image forming apparatus never gets involved with the process in which information is inputted into, or outputted from, the storage medium provided in a process cartridge. Therefore, it is possible to say that the information which a user can obtain regarding a process cartridge or an image forming apparatus is information regarding the amount of developer in a process cartridge, quality control, or the like. In other words, it is limited in latitude.

SUMMARY OF THE INVENTION

The primary object of the present invention is to provide an image forming apparatus and a process cartridge, which are capable of dealing with personal information such as a user's name or the purpose of usage.

An aspect of the present invention provides a process cartridge detachably mountable to a main assembly of an image forming apparatus, comprising: an image bearing member; and storing means for storing information which a user inputs using input means of the main assembly of the image forming apparatus, or an external device connected to the main assembly of the image forming apparatus Another aspect of the present invention provides an image forming apparatus comprising: a process cartridge detachably mountable to a main assembly of the image forming apparatus, the cartridge comprising an image bearing member, and storing means which is electrically connected to the main assembly of the image forming apparatus when the cartridge is mounted to the main assembly of the image forming apparatus; reading/writing means for reading the information stored in the storing means and writing information into the storing means; and a control panel for inputting information into the storing means.

A further aspect of the present invention provides a process cartridge detachably mountable to a main assembly of an image forming apparatus, comprising: developing means for developing a latent image formed on an image bearing member in the main assembly of an image forming apparatus; and storing means for storing information which a user inputs using input means of the main assembly of the image forming apparatus, or an external device connected to the main assembly of the image forming apparatus.

A further aspect of the present invention provides an image forming apparatus comprising: an image bearing member; a process cartridge detachably mountable to a main assembly of the image forming apparatus, the cartridge comprising developing means for developing a latent image formed on the image bearing member, and storing means which is electrically connected to the main assembly of the image forming apparatus when the cartridge is mounted to the main assembly of the image forming apparatus; reading/writing means for reading the information stored in the storing means and writing information into the storing means; and a control panel for inputting information into the storing means.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinafter, the electrophotographic image forming apparatus, the process cartridge, and the developing apparatus, which are in accordance with the present invention, will be described in detail with reference to the drawings.

Embodiment 1

Figure 3:
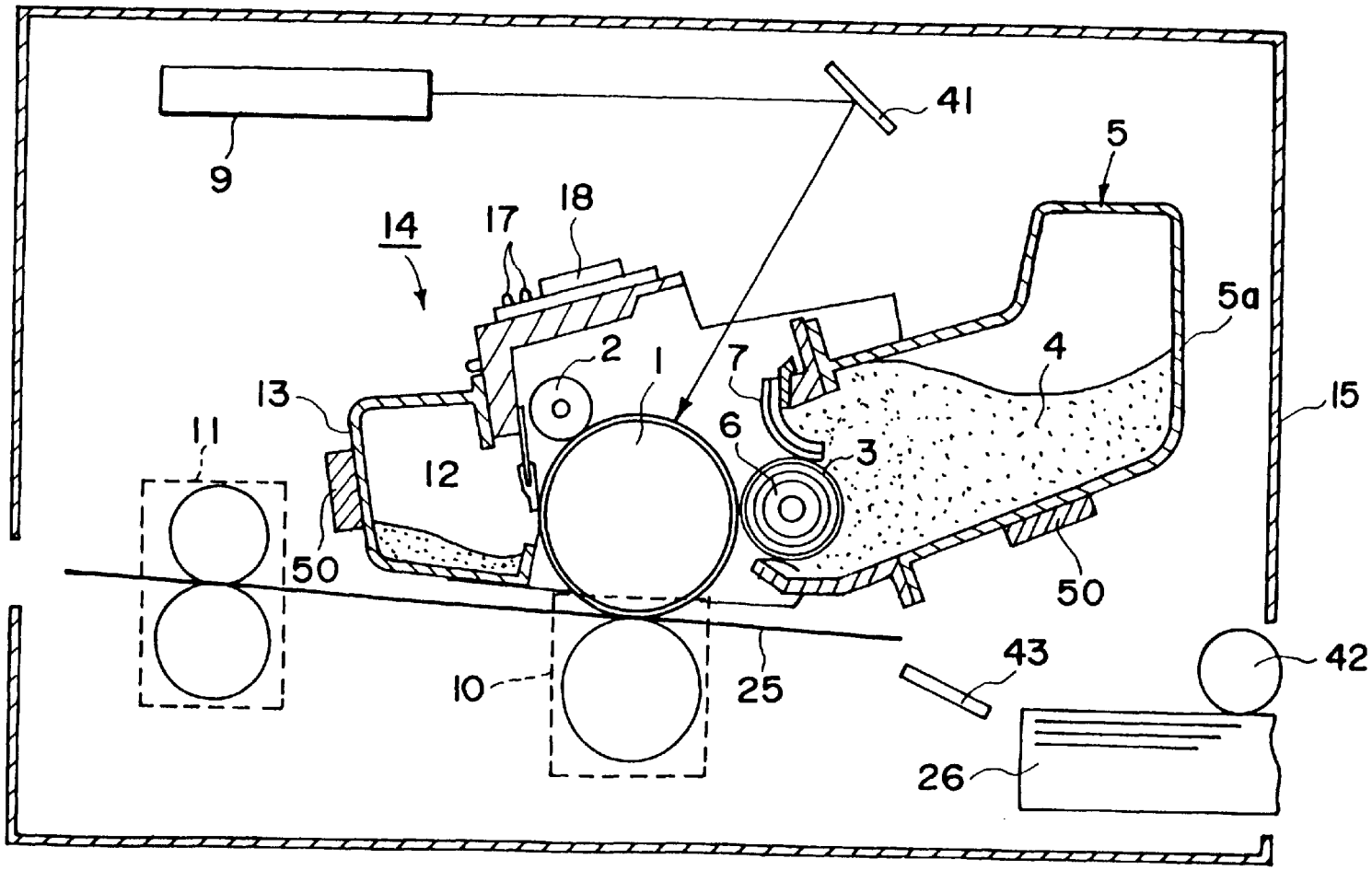
FIG. 3 is a sectional view of the process cartridge in the first embodiment, depicting the structure thereof.

To begin with, referring to FIG. 3, the first embodiment of an electrophotographic image forming apparatus in which the process cartridge structured in accordance with the present invention is installable will be described.

In the drawing, a photosensitive drum 1 is surrounded by a charge roller 2 as a contact type charging means, a development roller 3 as a developer carrying member, a transfer roller 10, a cleaning blade 12 as a cleaning means for removing the residual toner from the photosensitive drum 1. The development roller 3 is formed of a piece of aluminum pipe or the like.

The development roller 3 is rotatively disposed at the opening of the developer storage portion 5*a* which holds developer 4. The opening faces the photosensitive drum 1. In the development roller 3, a magnet 6 comprising a plurality of alternately positioned magnetic poles Ns and Ss is fixedly disposed; the magnet 6 does not rotated with the development roller 3. The magnetism of the magnet 6 causes the developer 4 to be borne on the surface of the development roller 3 which rotates in the direction of an arrow mark R1.

Further, the development roller 3 is in contact with an elastic blade 7 as a developer regulating member which extends in the direction opposite to the rotational direction of the development roller 3 indicated by the arrow mark R1. More specifically, the development roller 3 is in contact with the belly portion of the free end of the elastic blade 7. As the developer 4 carried by the development roller 3 passes through the contact point between the development roller 3 and the elastic blade 7, the thickness of the developer 4 is regulated. As a result, a thin layer of developer is formed on the development roller 3.

To the metallic core 8 of the charge roller 2, an oscillating voltage composed by superposing an AC voltage and a DC voltage is applied from an unillustrated electric power source through a sliding electrode (unillustrated) placed in contact with the metallic core 8. As a result, the peripheral surface of the photosensitive drum 1 obtains a predetermined amount of charge through a contact charge process.

The charged surface of the photosensitive drum 1 is exposed to a scanning laser beam projected from a laser scanner 9 mounted on the main assembly side of the image forming apparatus, to form an electrostatic latent image of an original.

As the development roller 3 rotates, the developer 4 on the development roller 3 is conveyed into a development station, in which the distance between the development roller 3, and the photosensitive drum 1 rotating in the direction of an arrow mark R2, becomes smallest. In the development station, the developer 4 on the development roller 3 is adhered to the latent image on the photosensitive drum 1, by electrical force; in other words, the latent image is developed.

Meanwhile, a recording material 25 as recording medium stored in a sheet feeder cassette 26 is fed out of the cassette 26 by a sheet feeder roller 42 in synchronism with the latent image formation on the photosensitive drum 1. This recording material 25 is conveyed by a conveying means 43 to a transferring means 10 in the form of a roller in such a manner that the arrival of its leading end synchronizes with the arrival of the leading end of the toner image on the photosensitive drum 1, and the toner image is transferred onto the recording material 25 by the transferring means 10. After the toner image transfer, the recording material 25 is conveyed to a fixing device 11, in which the toner image is fixed to the recording material 25, becoming a permanent image. A portion of the developer 4, which remains on the photosensitive drum 1, is scraped off by the cleaning blade 12, and is collected in a waste developer container 13. In the main assembly of the image forming apparatus in this embodiment, a process cartridge accommodating means 50, in which the process cartridge 14 is removably mounted, is provided at two locations.

Figure 2:
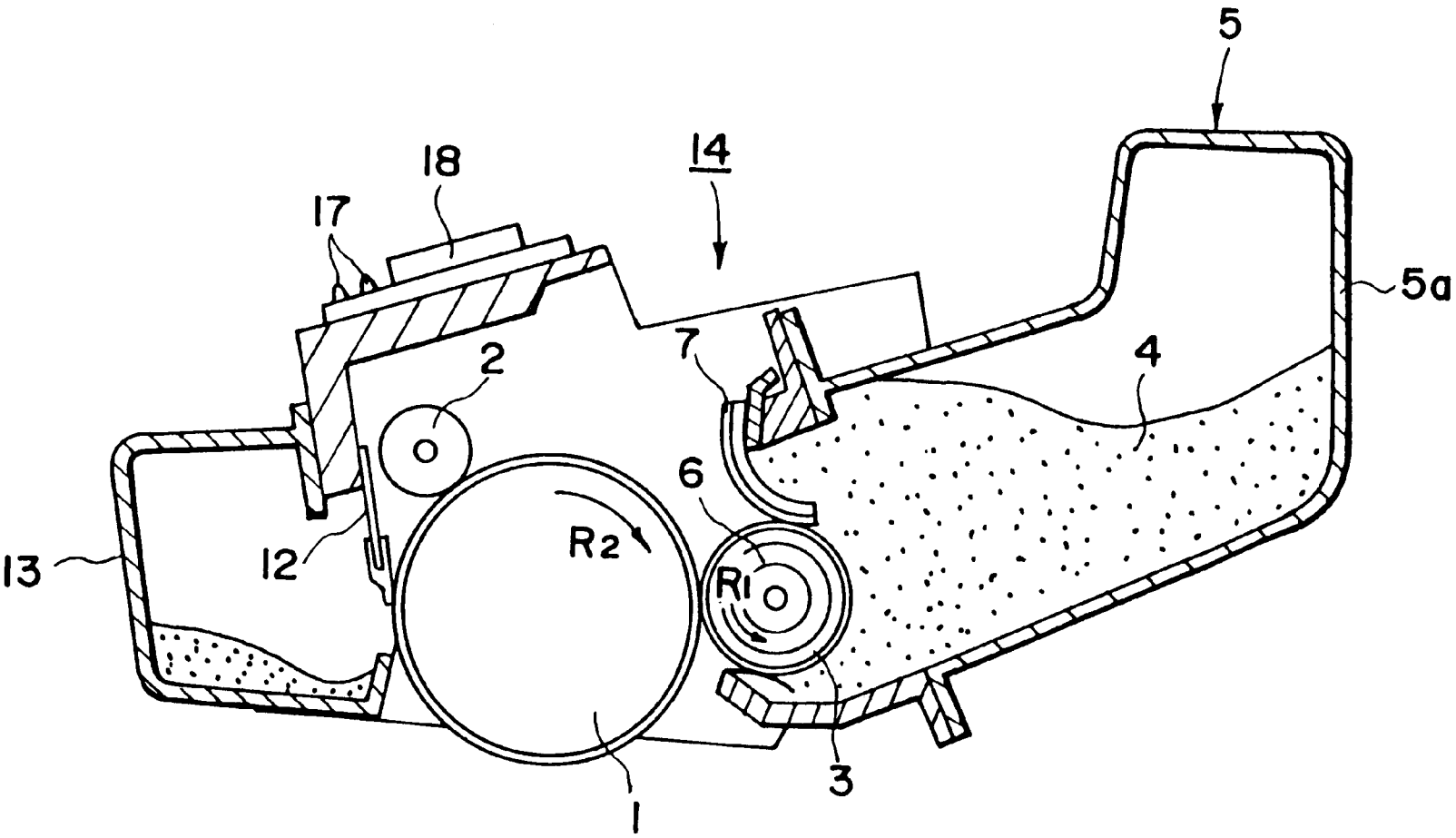
FIG. 2 is a sectional view of the process cartridge mountable in the image forming apparatus in the first embodiment, depicting the structure thereof.

In the process cartridge 14 illustrated in FIG. 2, the photosensitive drum 1, the charge roller 2, the developing apparatus 5, and the elastic cleaning blade 12 as the cleaning means, are integrally united. These components such as the photosensitive drum 1 are disposed in the process cartridge 14 so that their positional relationship among them meets predetermined specific requirements. For example, the process cartridge 14 must be inserted into, or removed from, a predetermined section (accommodating means 50) within the main assembly of the image forming apparatus, following a predetermined procedure.

Figure 1:
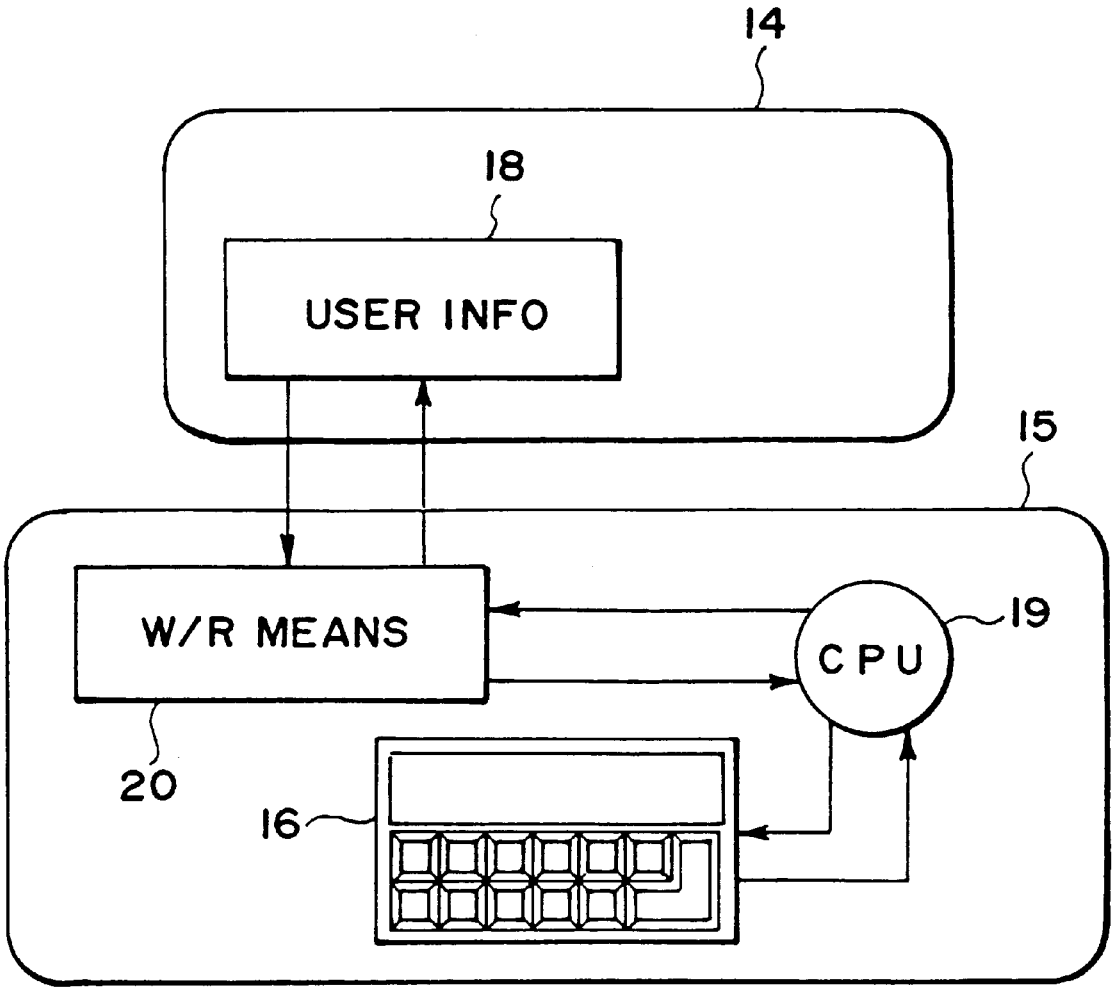
FIG. 1 is a block diagram depicting the controls in the first embodiment of the present invention.

Referring to FIG. 1, the process cartridge 14 in this embodiment is characterized in that it is provided with a storage medium 18 comprising a storage region where optional information inputted by a user through a display screen-equipped control panel 16 of the main assembly 15 of the image forming apparatus can be written or read through an information signal contact point 17 (FIG. 2).

In this embodiment, a non-volatile RAM with a storage capacity of 2 k bytes is employed as the storage medium 18. However, the storage medium 18 may be constituted of other storage media such as magnetic storage medium or optical storage medium.

Next, an image formation process will be further described with reference to FIG. 2. The developer 4 in the developer containing portion 5*a* is conveyed to the surface of the development roller 3. During this conveyance, the developer 4 is regulated in its thickness and also is charged, by the development roller 3 rotating in the direction of the arrow mark R1 in FIG. 2, and the elastic blade 7.

On the other hands the photosensitive drum 1 is rotated in the direction of the arrow mark R2 at a peripheral velocity of 40 revolutions per minute while a bias voltage composed by superposing a DC voltage of −600 V, and an AC voltage in the form of a sine wave having a peak-to-peak voltage of 1600 V is applied from the image forming apparatus main assembly 15 through a charge roller 2. As a result, the surface of the photosensitive drum 1 is charged to approximately −600 V. then, a latent image is drawn on the charged photosensitive drum 1 by a beam of light projected from the laser beam projecting apparatus 9 provided on the image forming apparatus main assembly 15 side.

Also, a bias voltage composed by superposing a DC voltage of −500 V and an AC voltage in the form of a sine wave having a peak-to-peak voltage of 1600 V is applied to the development roller 3 from the image forming apparatus main assembly 15. As a result, the developer 4 is caused to shuttle between the photosensitive drum 1 and the development roller 3. At this point of time, the actual potential at the surface of the photosensitive drum 1 is negative in both of the light portion and the dark portion of the latent image, and the developer 4 adheres to the surface of the photosensitive drum 1, being distributed by the amount proportional to the potential; in other words, the latent image is developed.

The image formed on the photosensitive drum 1 conveyed through the transfer station and fixing station provided in the image formation apparatus main assembly 15, in this order, to produce a fixed image on the recording sheet.

The portion of the developer 4, which remains on the photosensitive drum 1 after transfer, is scraped off by the cleaning blade 17 before the photosensitive drum 1 is charged again, and then is collected in the waste toner container portion 13.

Referring to the block diagram of FIG. 1, in this embodiment, the information inputted in the form of a character sequence, a numerical value, and the like by a user through the display screen-equipped control panel 16 is transmitted to a CPU 19 provided in the image forming apparatus main assembly 15 Then, a write instruction is issued to a writing/reading means 20 to write the information into the storage medium 18 of the process cartridge 14, and the information is written into the storage medium 18 by way of the information signal contact point 17.

Conversely, when the information stored in the storage medium 18 of the process cartridge 14 is accessed, the display screen-equipped control panel 16 is operated to issue a read instruction from the CPU to the writing/reading means 29. Then, the information is transmitted in the direction opposite to the writing direction, and the content of the information is outputted in the form of a character sequence, a numerical value, and the like, on the display screen of the display screen-equipped control panel 16.

In the case of the process cartridge 14 in this embodiment, personal information specific to each user such as the time of the first cartridge usage, a user name, a purpose of usage, and the like can be stored in the storage medium by the character sequences and numerical values inputted by a user through the display screen-equipped control panel 16. In other words, besides the information obtained in connection to the controls executed by an image forming apparatus, information peculiar to each user can be also dealt as a storable item. Therefore, usability is improved.

Embodiment 2

Figure 4:
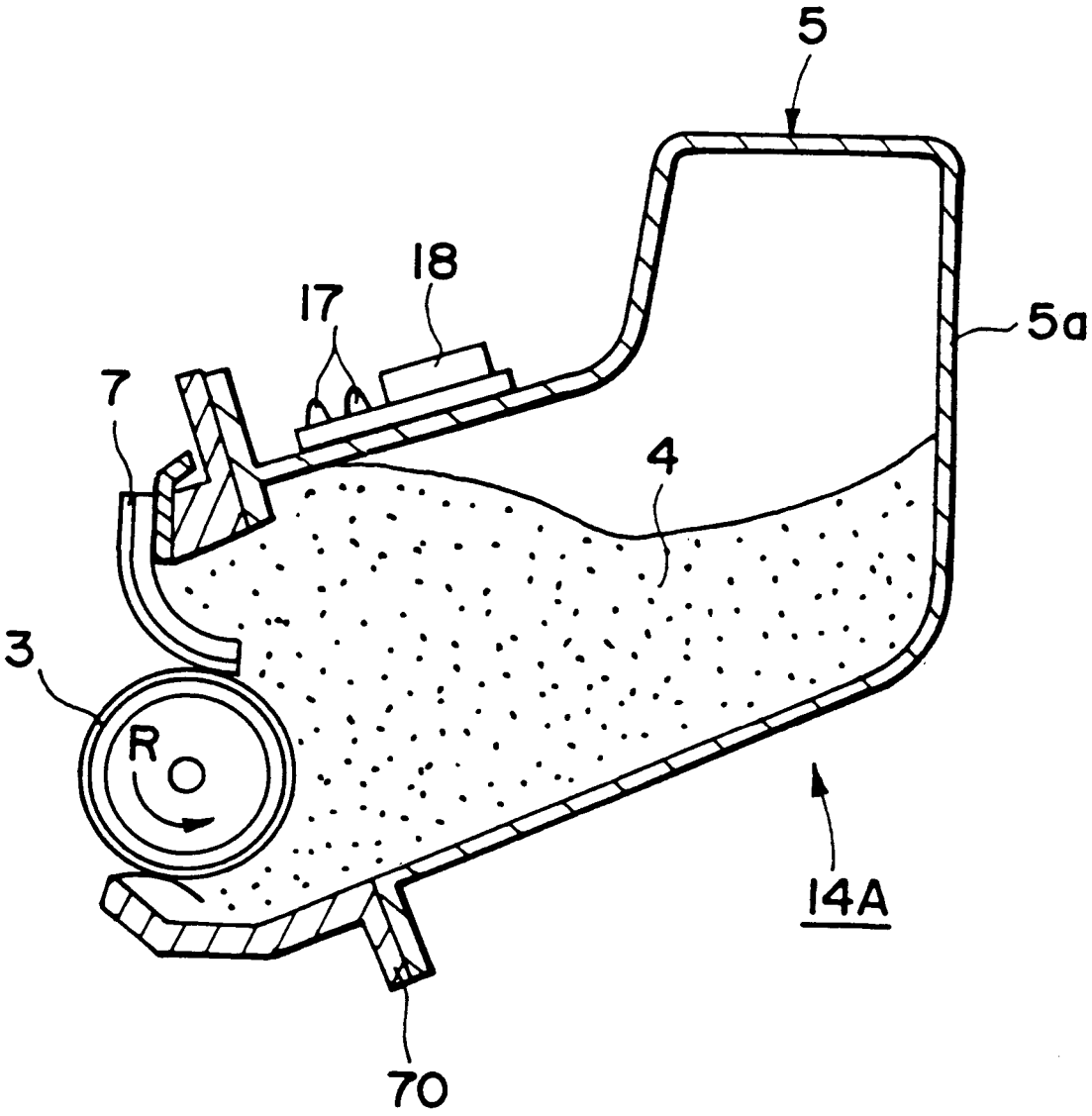
FIG. 4 is a sectional view of the developing apparatus in the second embodiment, depicting the structure thereof.

FIG. 4 illustrates a developing apparatus 14A in the form of a cartridge, in accordance with another aspect of the present invention.

In the developing apparatus 14A in this embodiment, a developer carrier member like a development roller, and a developing means 5 comprising a developer storage portion 5*a* for containing toner 4, are integrally disposed in a plastic frame 70. In other words, the developing apparatus 14A in this embodiment is considered to be substantially the same process cartridge as the process cartridge 14 described in the first embodiment, except for the absence of the photosensitive drum 1. Therefore, the structures and functions of the developer storage portion 5*a* and the like in this embodiment are identical to those in the first embodiment, and are designated with the same referential symbols as those in the first embodiment in order to substitute the descriptions in the first embodiment for the descriptions for those in this embodiment.

Embodiment 3

Next, referring to the block diagrams in FIGS. 5 and 6, the third embodiments of the image forming apparatus and process cartridge in accordance with the present invention will be described.

The image forming apparatus 21 in this embodiment is characterized in that it is provided with a writing/reading means for allowing a user to write optional information into, or read it from, a storage medium 18 provided in the process cartridge 14 mounted in the image forming apparatus, through the control panel of a computer 22 as an external device connected to the image forming apparatus main assembly.

In the image forming apparatus 21 in this embodiment, an electric power source 23 for charging the photosensitive drum 1, a laser beam projecting apparatus 24 for forming an electrostatic latent image, a sheet feeder cassette 26 for holding a recording sheet 25, a transfer roller 27 for transferring a developer image onto the recording sheet 25, and a fixing device 28 for fixing the developer image to the recording sheet 25, are appropriately disposed, on condition that the process cartridge 14 described in the first embodiment is mounted in the image forming apparatus 21 to carry out an image forming operation. Further, one of the lateral walls of the image forming apparatus 21 is provided with a connector (unillustrated) which is connected to the computer 22 to transmit image information, operational information, and the like.

Figure 5:
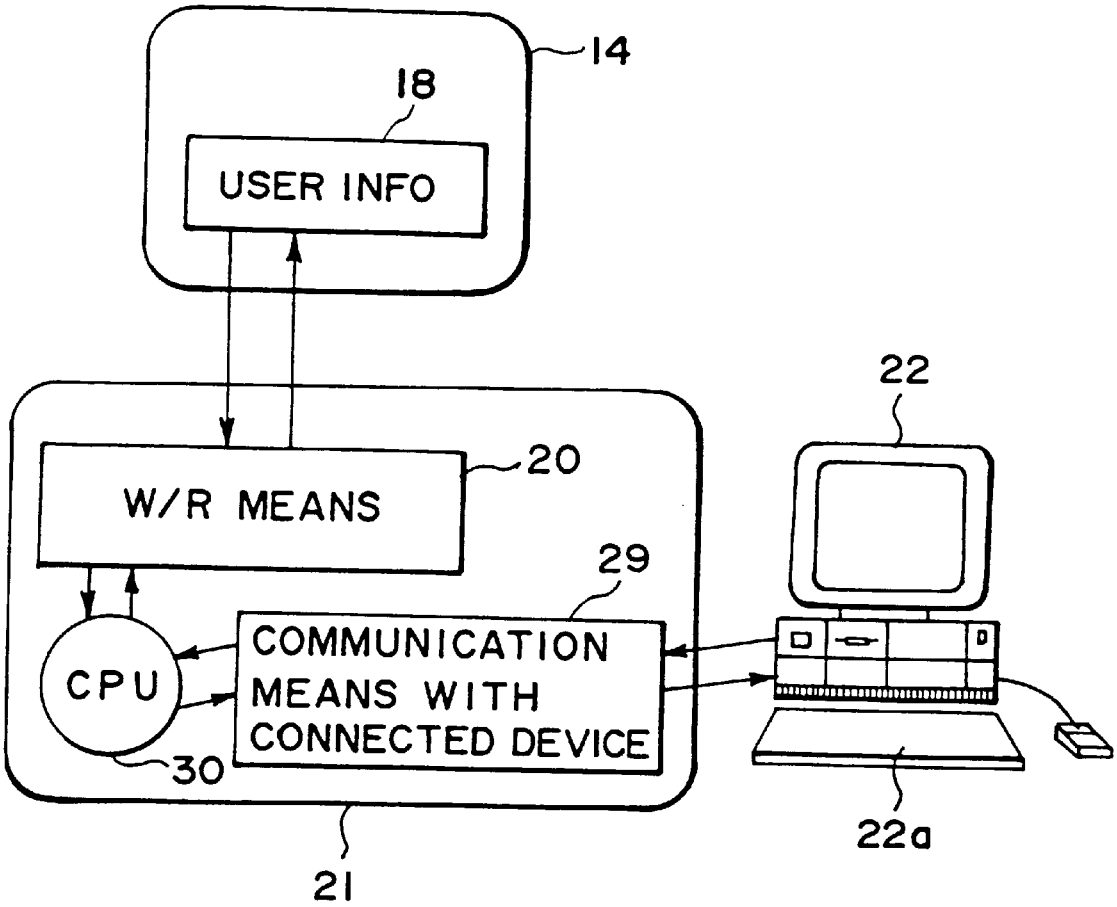
FIG. 5 is a block diagram depicting the controls in the third embodiment.
Figure 6:
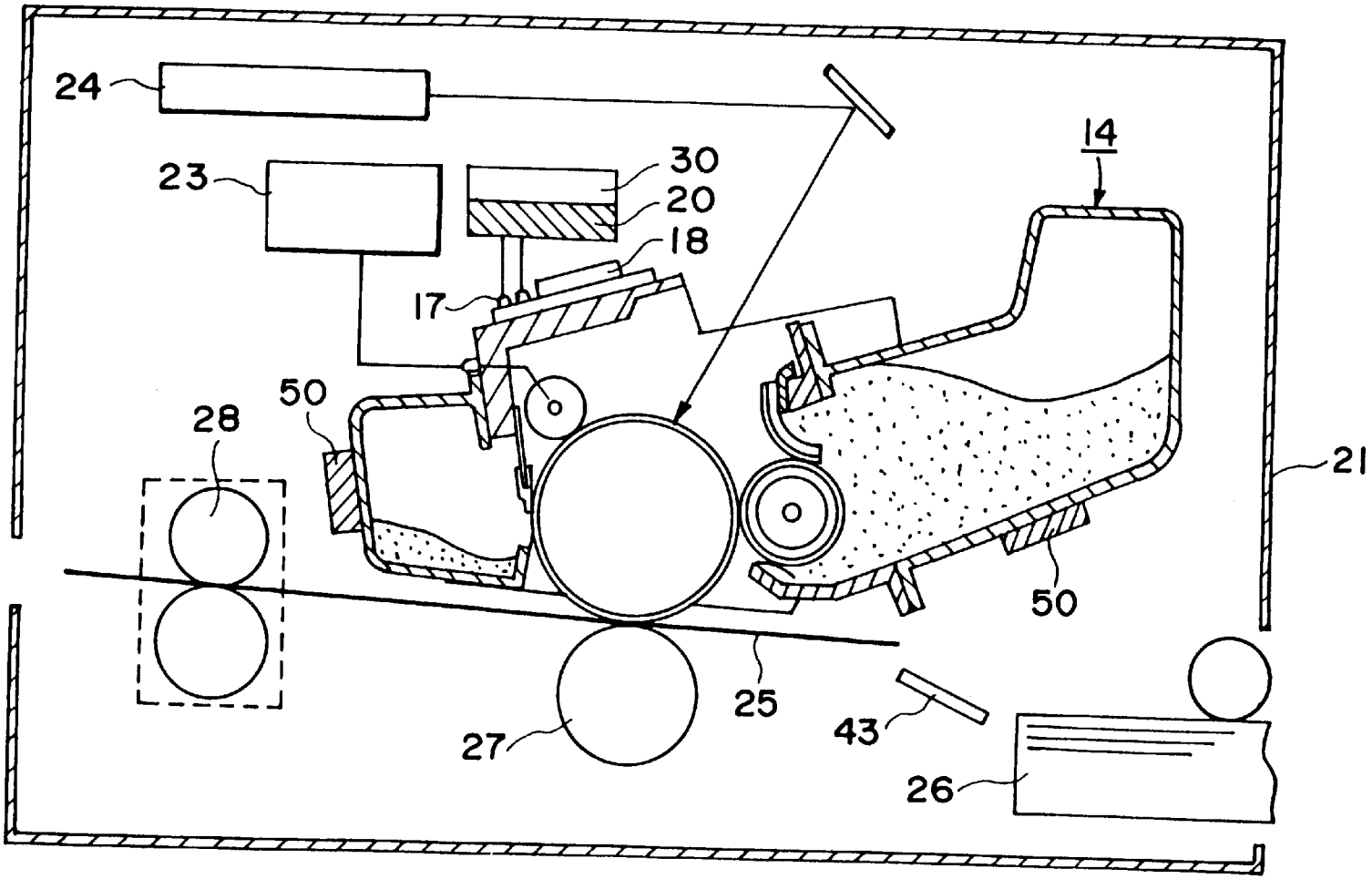
FIG. 6 is a sectional view of the image forming apparatus in the third embodiment, depicting the general structure thereof.

Referring to FIG. 5, this image forming apparatus 21 is connected to the computer 22 in which a driver software for controlling the information exchange between the image forming apparatus 21 and the computer 22 has been installed.

The information inputted in the form of a character sequence or a numerical value by a user through the key board 22*a* of the computer 22 is transmitted to the CPU 30 by way of a connector (unillustrated), and a communicating means provided in the image forming apparatus to establish communication between the image forming apparatus and the devices connected thereto. The CPU 30 executes the write instruction issued to the writing/reading means 20 to write information into the recording means 18 of the process cartridge 14 As a result, information is written into the storage medium 18 through the information signal contact point 17.

On the contrary, in order to peruse the information stored in the storage medium 18 of the process cartridge 14, a user is to operate the key board of the computer 22 to input such an instruction that causes the CPU 30 to issue an instruction for instructing the writing/reading means to read out the information pertaining to the instruction. Then, the instruction is transmitted to the CPU 30 by the connecting device and the communicating means 29, whereby the accessed information is transmitted in the direction opposite to the direction in which the information is transmitted when it is written, and the content of the information is outputted on the display screen of the computer 22 in the form of a character sequence, a numerical value, and the like.

In the case of the process cartridge 21 in this embodiment, personal information specific to each user such as the time of the first cartridge usage, a user name, a purpose of usage, and the like can be stored in the storage medium 18 of the process cartridge 14 by the character sequences and numerical values inputted by a user through the key board 22*a* of the externally connected computer 22. In other words, besides the information obtained in connection-with the controls executed by an image forming apparatus 21, information peculiar to each user can be also dealt as a storable items. Therefore, usability is improved.

Further, the above-described operation can be carried out while the purpose cartridge 14 is in the image forming apparatus 21. In other words, the process cartridge 14 in this embodiment can be used in the same manner as a conventional process cartridge 14 or a conventional image forming apparatus 21 is used. Therefore, it is possible to provide an image forming apparatus 21 superior in operational efficiency and usability.

Embodiment 4

Figure 7:
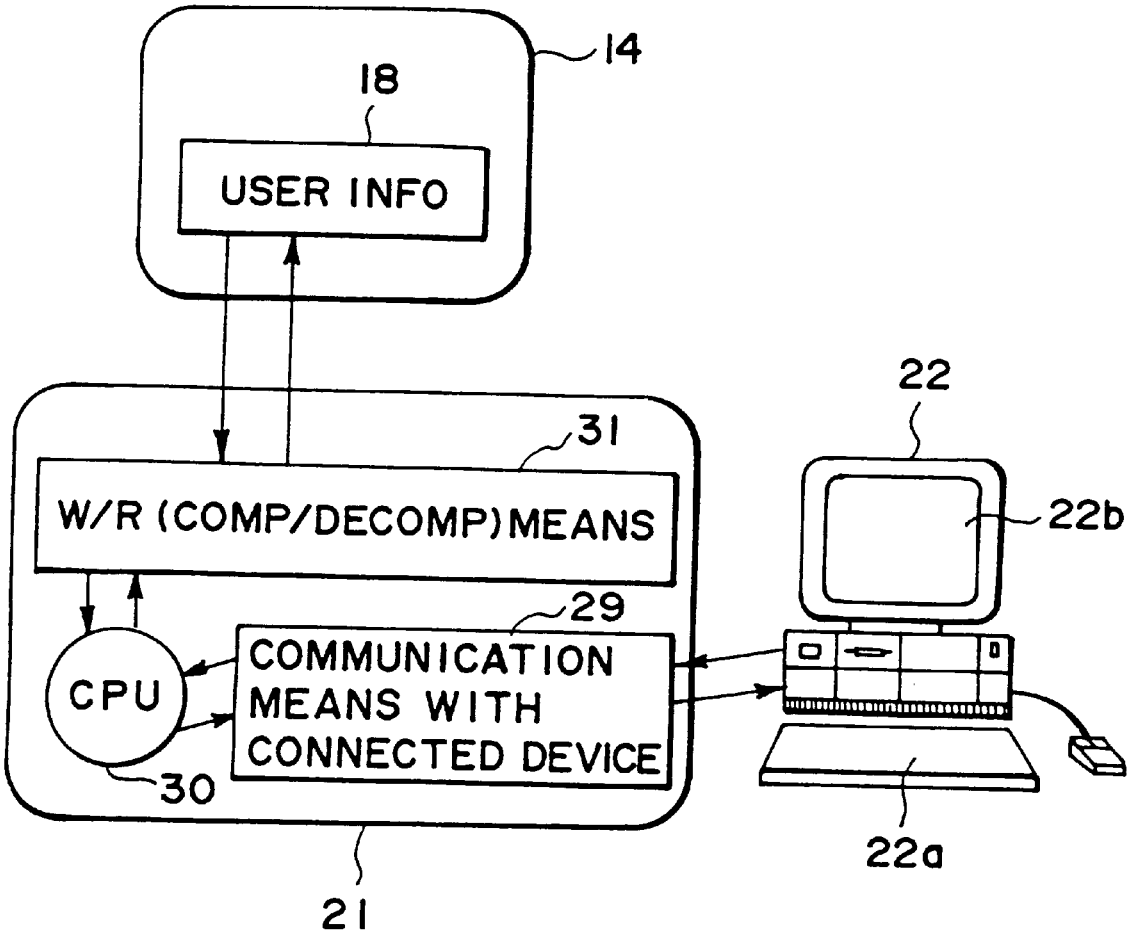
FIG. 7 is a block diagram depicting the controls in the fourth embodiment.

Next, the process cartridge and electrophotographic image forming apparatus in the fourth embodiment of the present invention will be described with reference to the block diagram given in FIG. 7.

The image forming apparatus in the preceding third embodiment comprised the writing/reading means 20 which allowed a user to write optional information into the storage medium 18 provided in the process cartridge 14 in the image forming apparatus main assembly, or read it therefrom, by operating the computer 22 connected to the image forming apparatus main assembly In comparison, the image forming apparatus 21 in this embodiment is characterized in that it is provided with a writing/reading means 31 which compresses information as it writes the information into the recording 18, and decompresses the compressed information as it reads out the compressed information stored in the storage medium 18.

Referring to FIG. 17, the image forming apparatus 21 is connected to a computer 22 in which a driver software for exchanging information with an image forming apparatus has been installed.

The information inputted in the form of a character sequence or a numerical value by a user through the key board 22*a* or the computer 22 is transmitted to the CPU 30 by way of a connector (unillustrated), and a communicating means provided in the image forming apparatus to establish communication between the image forming apparatus and the devices connected to thereto. The CPU 30 issues a write instruction to the writing. (compressing)/reading (decompressing) means 20 to write information into the recording mean 18 of the process cartridge 14. As a result, information is written, in the compressed form, into the storage medium 18 through the information signal contact point 17.

On the contrary, in order to peruse the information stored in the storage medium 18 of the process cartridge 14, a user is to operate the key-board of the computer 22 to input such an instruction that causes the CPU 30 to issue an instruction which instructs the writing (compressing)/reading (decompressing) means 31 to read out the information pertaining to the instruction. Then, the instruction is transmitted to the CPU 30 by the communicating means 29, whereby the accessed information is decompressed and transmitted in the direction opposite to the direction in which the information is transmitted to be written in the compressed form, end the content of the decompressed information is outputted on the display 22*b* of the computer 22 in the form of a character sequence, a numerical value, and the like.

In the case of the process cartridge 21 in this embodiment, personal information specific to each user such as the time of the first cartridge usage, a user name, a purpose of usage, and the like can be stored in the storage medium 18 of the process cartridge 14 by the character sequences and numerical values inputted by a user through the key board 22*a* of the externally connected computer 22.

In addition, the capacity of the storage medium for the process cartridge can be rendered smaller than that in the preceding embodiment, while affording a user the same amount of latitude in dealing with optional information. Therefore, it is possible to provide a user with an inexpensive yet highly functional process cartridge.

Embodiment 5

Figure 8:
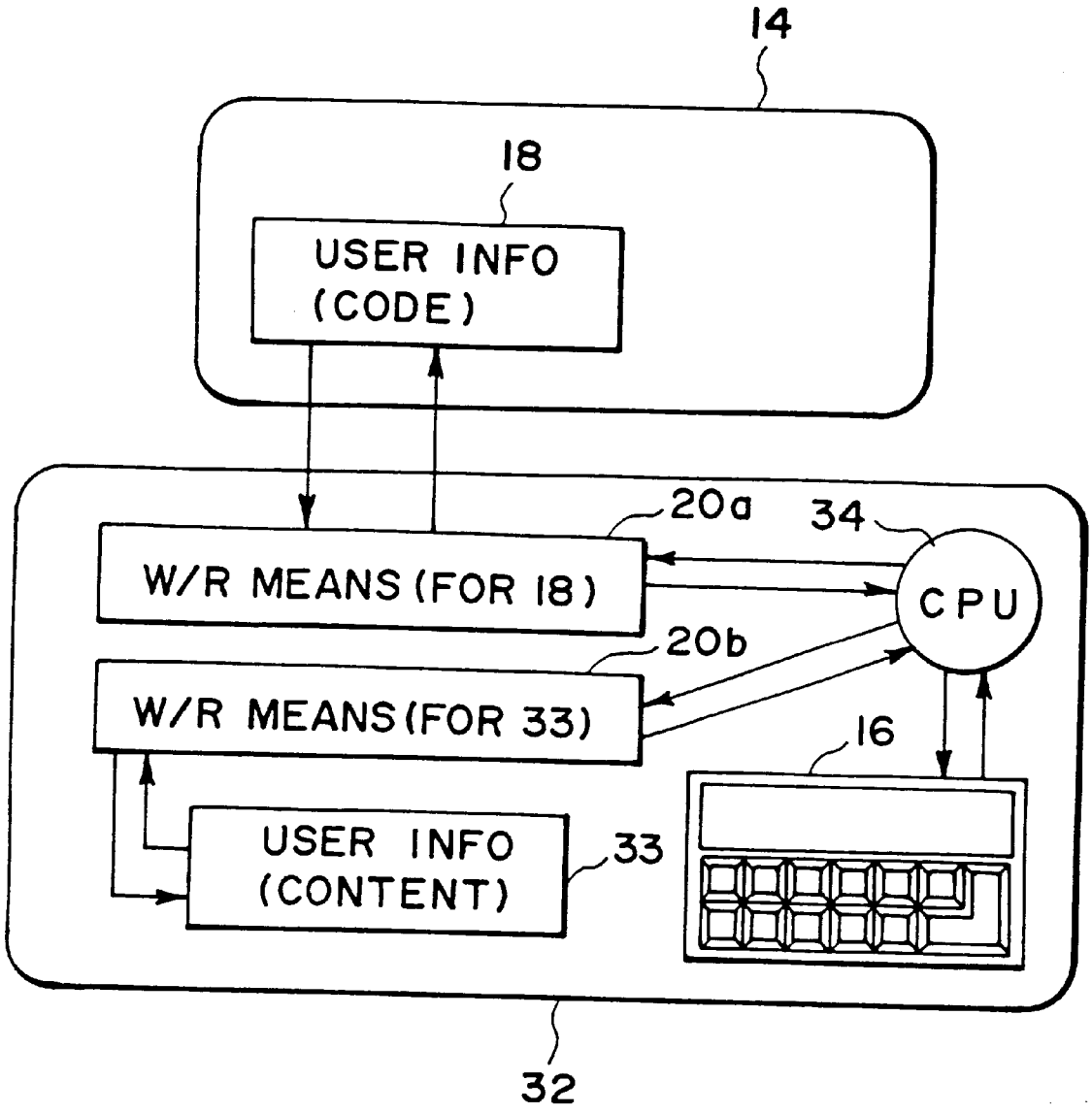
FIG. 8 is a block diagram depicting the controls in the fifth embodiment.

Next, referring to FIGS. 8 and 9, the electrophotographic image forming apparatus in the fifth embodiment of the present invention will be described.

The image forming apparatus 32 in this embodiment is characterized in that it executes such a control that each time a user inputs information by operating the display screen-equipped control panel 16 provided in the image forming apparatus main assembly, an identification code, which can be represented with a smaller volume of data than the volume of data required to represent the inputted information itself, is assigned to the inputted information, and this identification code is written into the storage medium 18 provided in the process cartridge 14, whereas the content of the information is written, together with its identification code, into a storage medium 33 provided in the image forming apparatus main assembly, and that when the information is read, the information content whose identification code matches the identification code stored in the storage medium 18 of the process cartridge 14 is read out of the storage medium 33 of the image forming apparatus 32.

In the image forming apparatus 32 in this embodiment, an electric power source 23 for charging the photosensitive drum, a laser beam projecting apparatus 24 for forming an electrostatic latent image, a sheet feeder cassette 26 for holding a recording sheet 25, a transfer roller 27 for transferring a developer image onto the recording sheet 25, and a fixing device 28 for fixing the developer image to the recording sheet 25, are appropriately disposed, on condition that the process cartridge 14 having a structure like that of the cartridge 14 described in the first embodiment is mounted in the image forming apparatus 32 to carry out an image forming operation.

Further, in comparison with the process cartridge in the preceding embodiment, the process cartridge employed in the image forming apparatus in this embodiment is different only in that the storage capacity of the storage medium in this embodiment is arranged to be 256 bytes, and this storage capacity is provided by a non-volatile RAM from which the storage region where a user can optionally input or output information has been eliminated.

In this embodiment, each information which a user inputs in the form of a character sequence or a numerical value through the display-equipped control panel 16 is sent to the CPU 34, in which an identification code, that is, one of alphabetic characters A–Z, is assigned to each information. However, the identification code may be different from the alphabetical code used in this embodiment. In any case, it is desirable that the information is represented by a character such as a numerical character which can be represented by a smaller volume of data than the volume of data for the inputted information itself, or a dot matrix which measures only four bytes or so.

After the completion of the above-described identification code assigning operation, the CPU 34 writes the pertinent identification code into the storage medium 18 of the process cartridge 14 through the writing/reading means 20*a* provided in the process cartridge 14 to write information into the storage medium 18, or read it therefrom. At the same time, the CPU 34 writes the content of the information, along with the correspondent identification code, into the storage medium 33 of the image forming apparatus 32 through a writing/reading means 20*b* provided in the image forming apparatus main assembly to write information into the storage medium 33 provided in the image forming apparatus 32, or read it therefrom.

On the contrary, when a user wishes to peruse the previously inputted information, the user is to instruct the CPU 34 to read out the information, by operating the display screen-equipped control panel Then, the identification code is read out of the storage means 18 of the process cartridge 14 by the writing/reading means 20*a* provided for the storage means 18.

Next, the CPU 34 peruses the identification codes and correspondent information consents in the storage medium 33 of the image forming apparatus 32, through the writing/reading means 20*b* provided for the storage medium 33, and searches them for the information content matching the identification code read from the process cartridge 14, and outputs the content of the matching information on the display screen-equipped control panel 16, in the form of a character sequence, a numerical value, and the like.

With regard to the controls for the above described operational sequence, writing of information into the storage medium 18 of the process cartridge 14, or reading of information therefrom, is carried out through the information signal contact point 17.

In the case of the image forming apparatus 32 in this embodiment, personal information specific to each user such as the time of the first cartridge usage, a user name, a purpose of usage, and the like can be stored in the storage medium provided in the process cartridge 14, in the form of the character sequences and numerical values inputted by a user through the control panel 16 In other words, besides the information obtained in connection to the controls executed by an image forming apparatus 32, information peculiar to each user can be also handled as a storable item. Therefore, usability is improved.

Further, even when a set of information requiring a large storage capacity is dealt with, the content actually stored in the storage medium of the process cartridge 14 is nothing but an identification code requiring only a small number of bytes. In other words, in comparison to the case in which the information content is entirely stored, the capacity of the storage medium provided in the process cartridge can be reduced. Therefore, it is possible to control the cost increase of a process cartridge which is essentially an expendable item, to inexpensively provide a user with the aforementioned usability.

Embodiment 6

Figure 10:
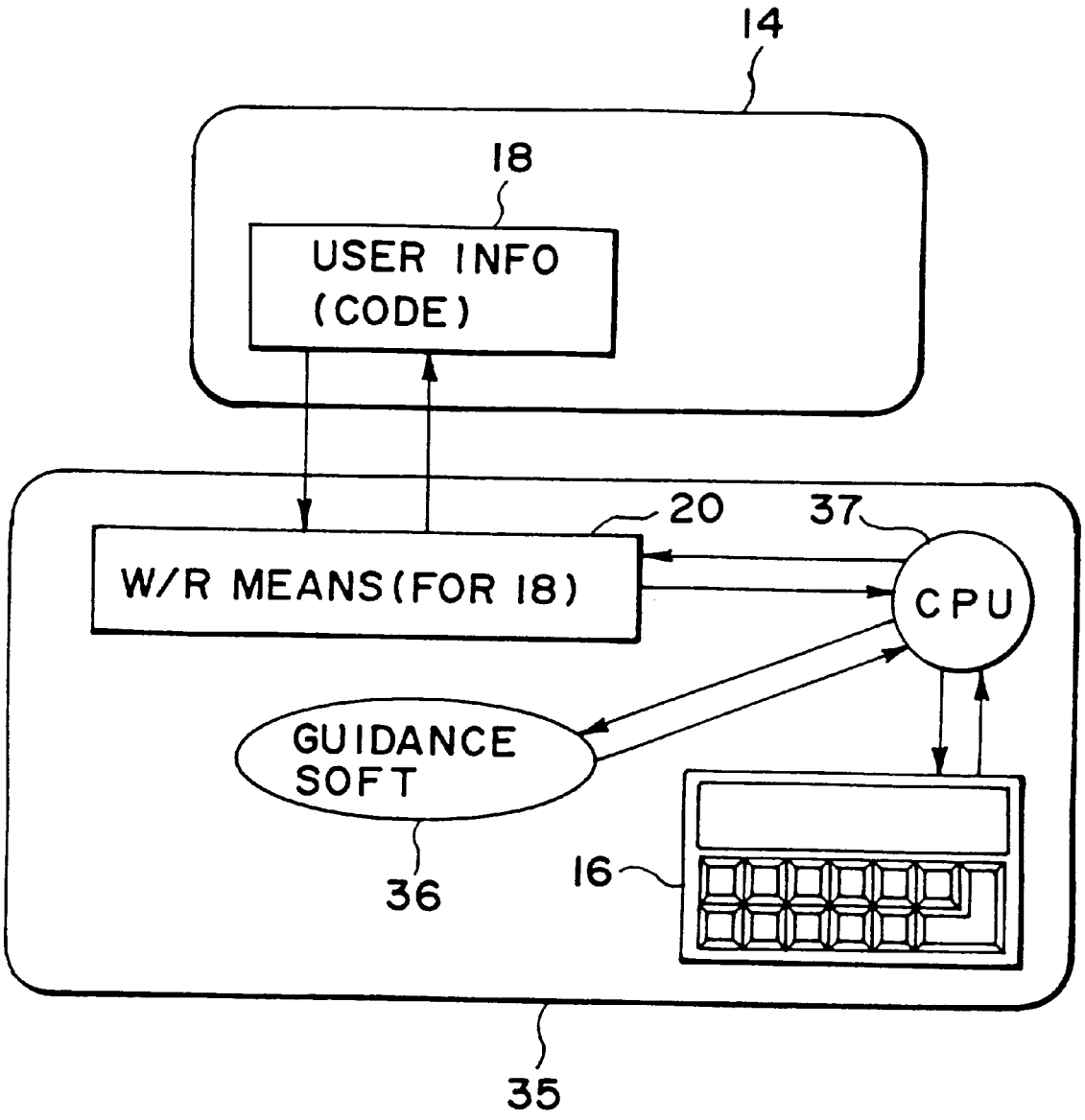
FIG. 10 is a block diagram depicting the controls in the sixth embodiment.

Next, referring to FIG. 10, the process cartridge and electrophotographic image forming apparatus in the sixth embodiment of the present invention will be described.

On the premise that in order to form an image, the process cartridge 14 described in the first embodiment must be installed in the image forming apparatus in this embodiment, the process cartridge in this embodiment is characterized in that a guidance software 36 for allowing a user to input optional information into the storage medium 18 of the process cartridge 14, or output it therefrom, displays a list of various input contents predesignated by an identification code, and as the user makes a choice from the list, only the identification code of the user's choice of input content is stored in the storage medium 18 of the process cartridge 18.

Figure 9:
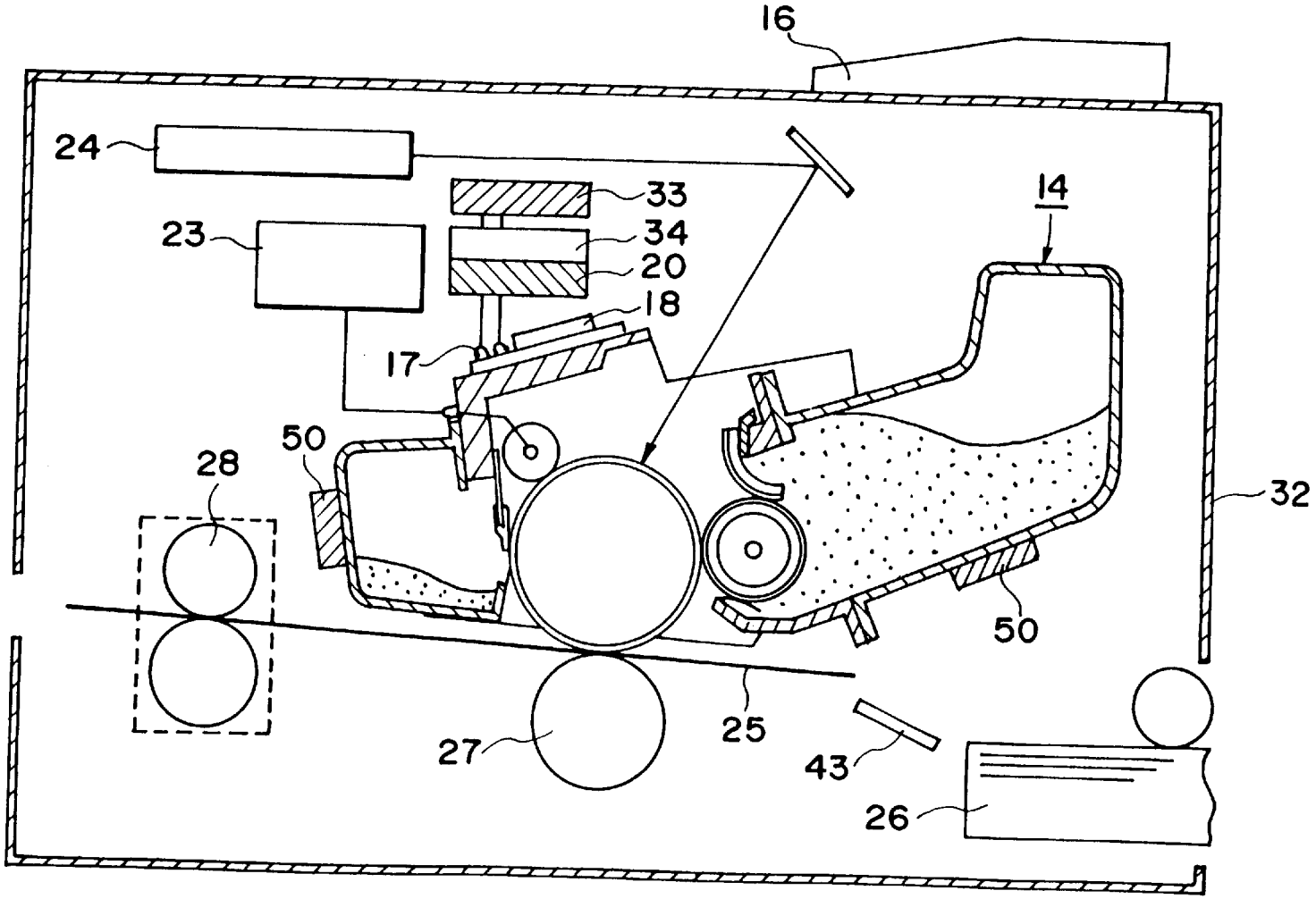
FIG. 9 is a sectional view of the image forming apparatus in the fifth embodiment, depicting the general structure thereof.

On the premise that the process cartridge 14 described in the first embodiment must be mounted in the image forming apparatus in order to carry out an image forming operation, an electric power source 23 for charging the photosensitive drum 1, a laser beam projecting apparatus 24 for forming an electrostatic latent image, a sheet feeder cassette 26 for holding a recording sheet 25, a transfer roller 27 for transferring a developer image onto the recording sheet 25, and a fixing device 28 for fixing the developer image to the recording sheet 25, are appropriately disposed in the image forming apparatus in this embodiment as shown in FIG. 9.

When a user wishes to input information into the storage medium 18 provided in the process cartridge 14 through the display screen-equipped control panel 16, the user is to start first the guidance software 36. The guidance software 36 is run by a CPU 37 to display a written guidance, and a list of the choices designated by a preassigned identification code, on the display screen-equipped control panel 16.

It is desirable that the identification codes be characters such as numerals or alphabetic characters representable by a small number of bytes, and in this embodiment, they are numerals 1, 2 and 3, and each of these numerals is assigned to one of three buttons provided on the display screen-equipped control panel 16.

A user is to make a choice from the list of input items by manipulating the three buttons 1, 2 or 3. Then, only the identification codes of the selected input items are sequentially stored by the instruction from the CPU 37, in the storage medium 18 of the process cartridge 14 through the writing/reading means 20 provided for the storage medium 18 of the process cartridge 14.

Even when a user wishes to peruse the previously inputted information instead of inputting information, the user is to start first the aforementioned guidance software by operating the display screen-equipped control panel 16. Then, the identification codes are sequentially read out of the storage medium 18 of the process cartridge 14 by the writing/reading means 20 provided for the storage medium 18. During this process, the CPU 37 queries the input permutation of the guidance software 36 to look for the specific array of the identification codes read out of the storage medium 18, and then, outputs the information content meant by each of the identification codes, in the form of a character sequence, a numerical value, and the like, on the display screen of the display screen-equipped control panel 16.

Regarding the control described in the foregoing, writing of information into the storage medium 18 of the process cartridge 14, or reading it therefrom, is carried out through the information signal contact point 17.

Figure 11:
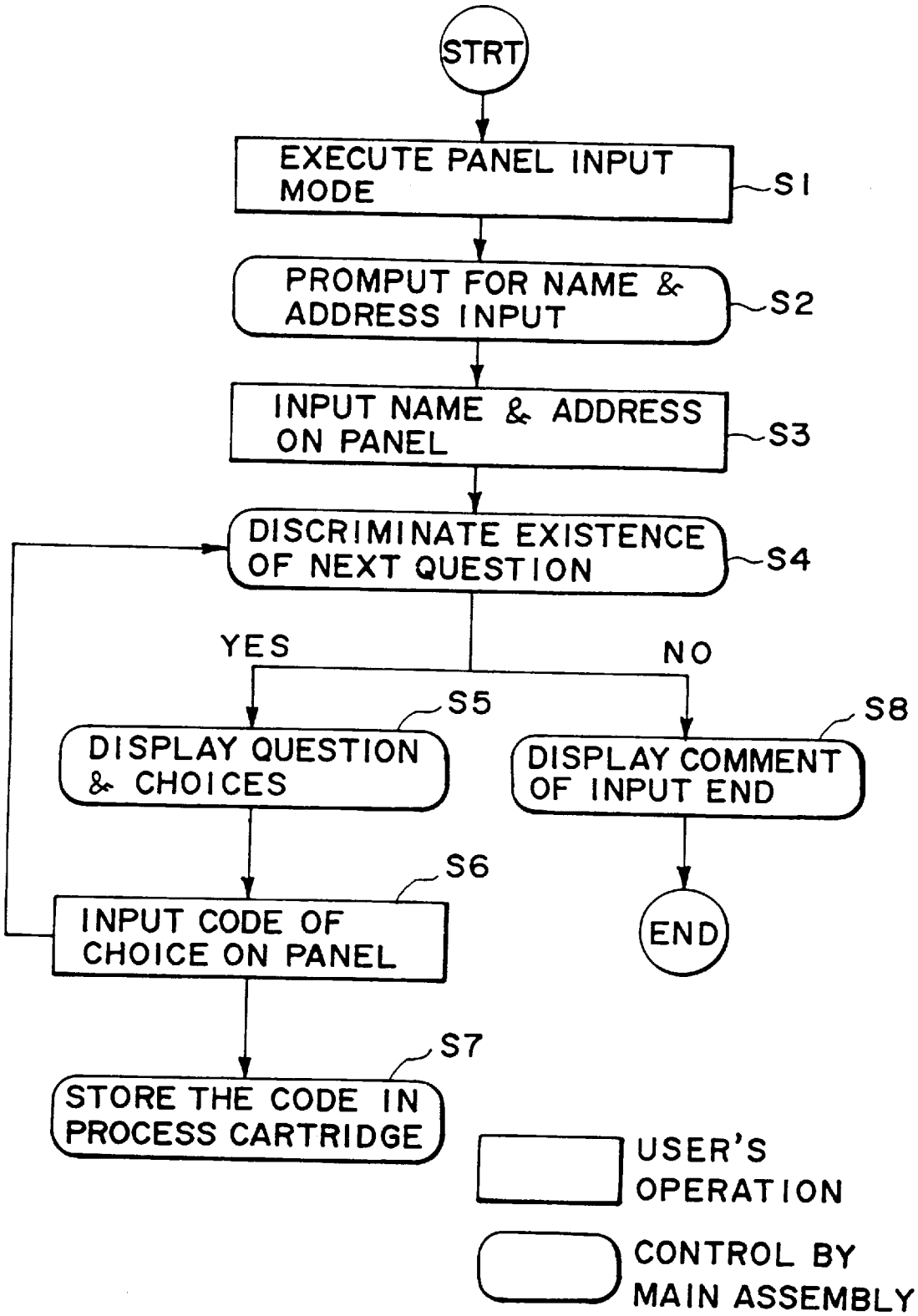
FIG. 11 is a flow chart depicting the control flow in the six embodiment.

Further, in this embodiment, in order to confirm the effects of the present invention, an imaginary situation, that is, a rare situation in which the process cartridge 14 had a trouble, was set up, and the aforementioned image forming apparatus was tested as a means for passing the condition of the trouble from an actual user to a supplier (maker). The procedure carried out at that time to input the information is shown by the flow chart in FIG. 11.

First, a user is to install the malfunctioning cartridge into the image forming apparatus main assembly, and is to start the guidance software 36 (S1). Then, the guidance software 36 prompts the user to input the user name and the address at which the user is to be notified (S2). At this point, the user name or the like are directly stored in the storage medium 18 of the process cartridge 14, without assigning an identification code This is because these data are too multifaceted to be standardized. Next, the user input the name and contact address of the user (S3).

Next, a decision is made as to whether there is a question or not (S4). When there is a question, a list of choices describing the cartridge troubles is displayed on the display screen (S5), wherein each choice is predesignated by an identification code, that is, one of the numbers 1–3 in this embodiment, and the user is prompted to input the identification code, that is, the identification number, of the cartridge trouble experienced by the user. As the user input the identification numbers selected from the list of choices, by using the buttons provided on the display screen-equipped control panel 16 (S6), the identification numbers (codes) are stored in the storage medium 18 of the process cartridge 14 (S7). Then, the operation goes back to step 4.

When there is no more question in step 4 (S4), a comment indicating the completion of the information input mode is displayed on the screen (S8).

However, when there is another question, the user is prompted to make another choice from the sequentially displayed list, and input the identification number of the additionally selected choice, by manipulating the buttons on the control panel 16. In this manner, the trouble experienced by the user can be expressed in detail.

On the other hand, after user has inputted the data relating to the trouble, the data reader which has the function similar to the control carried out by the image forming apparatus of this embodiment (supplier side), compares the choices presented by the guidance software 36 and the identification codes stored in the recording medium 18 of the process cartridge, and it displays the contents of the choices corresponding to the respective identification codes.

As described above, according to this embodiment, some of process cartridge troubles, which are difficult for a user to describe in detail to a supplier, can be described by a simple operation such as manipulating a limited number of buttons. Therefore, the supplier can grasp in detail the process cartridge troubles which the user wishes to point out. Consequently, the supplier can quickly and properly deal with trouble.

Further, even a process cartridge trouble description, which requires a large storage capacity to store, can be described by combining, step by step, relatively short descriptions of a process cartridge trouble, which are chosen from sequentially displayed hierarchical lists of process cartridge troubles. Also in this case, the content to be stored in the storage medium 18 of the process cartridge 14 is nothing but a sequence of identification codes amounting to only a small amount of data. Therefore, a storage medium which has an extremely small storage capacity, and therefore is inexpensive, can be used as the storage medium 18 of the process cartridge 14, making it possible to improve the aforementioned usability while minimizing the cost increase of a process cartridge which is basically an expendable item.

Embodiment 7

Next, the process cartridge and electrophotographic image forming apparatus in the seventh embodiment of the present invention will be described with reference to the block diagram in FIG. 12 and the flow charts in FIG. 13.

On the premise that in order to carry out an image forming operation, the process cartridge 14 described in the first embodiment must be mounted in the image forming apparatus main assembly, the image forming apparatus 38 in this embodiment is characterized in that it is provided with an inputting/outputting means for allowing a user to input optional information regarding the controls of the image forming apparatus 38, into the storage medium 18 of the process cartridge 14, and that after the process cartridge 14 is installed in the image forming apparatus main assembly, the control setting of the apparatus is changed based on the optional apparatus control setting information having been installed in the storage medium 18 of the process cartridge 14 by a user.

Further, in the image forming apparatus 38 of embodiment, an electric power source 23 for charging the photosensitive drum 1, a laser beam projecting apparatus 24 for forming an electrostatic latent image, a sheet feeder cassette 26 for holding a recording sheet 25, a transfer roller 27 for transferring a developer image onto the recording sheet 25, and a fixing device 28 for fixing the developer image to the recording sheet 25, are appropriately disposed as they are in the image forming apparatus 38 of the third embodiment 3.

As a user make a selection from a list of modes for inputting control setting information into the storage medium 18 provided in the process cartridge 14, using the display screen-equipped control panel 16 (S11), the CPU 39 issues a readout instruction to the writing/reading means 20 provided for the storage medium 18, and the current control setting information is read out (S12). Then, the current control setting information is displayed on the display screen-equipped control panel 16 (S13)

Next, the user inputs optional control setting information using the control buttons (S14), whereby new control setting information is inputted into the storage medium 18 of the process cartridge 14 (S15). Then, the new control setting information is read out of the storage medium 18 of the process cartridge 14 (S16), and is displayed on the display screen of the display screen-equipped control panel 16 (S17). Thereafter, the user is to get out of the mode for changing the control setting information by operating the control panel (S18).

In the case of the image forming apparatus in this embodiment, in order to simplify the operation for changing the control setting, and reduce the capacity of the storage medium 18, the content of the control setting information is represented by an imaginary display switch, for example, "high density printing mode (on/off)", "low density printing mode (on/off)", which displays a status 1 (ON) or a status 0 (OFF). Therefore, a user can confirm the current control setting for the image forming apparatus from the ON or OFF status of the display switches, and then can write the new control setting information (array consisting of 1 and 0) into the storage medium 18 through the means for writing/reading control setting information.

Figure 14:
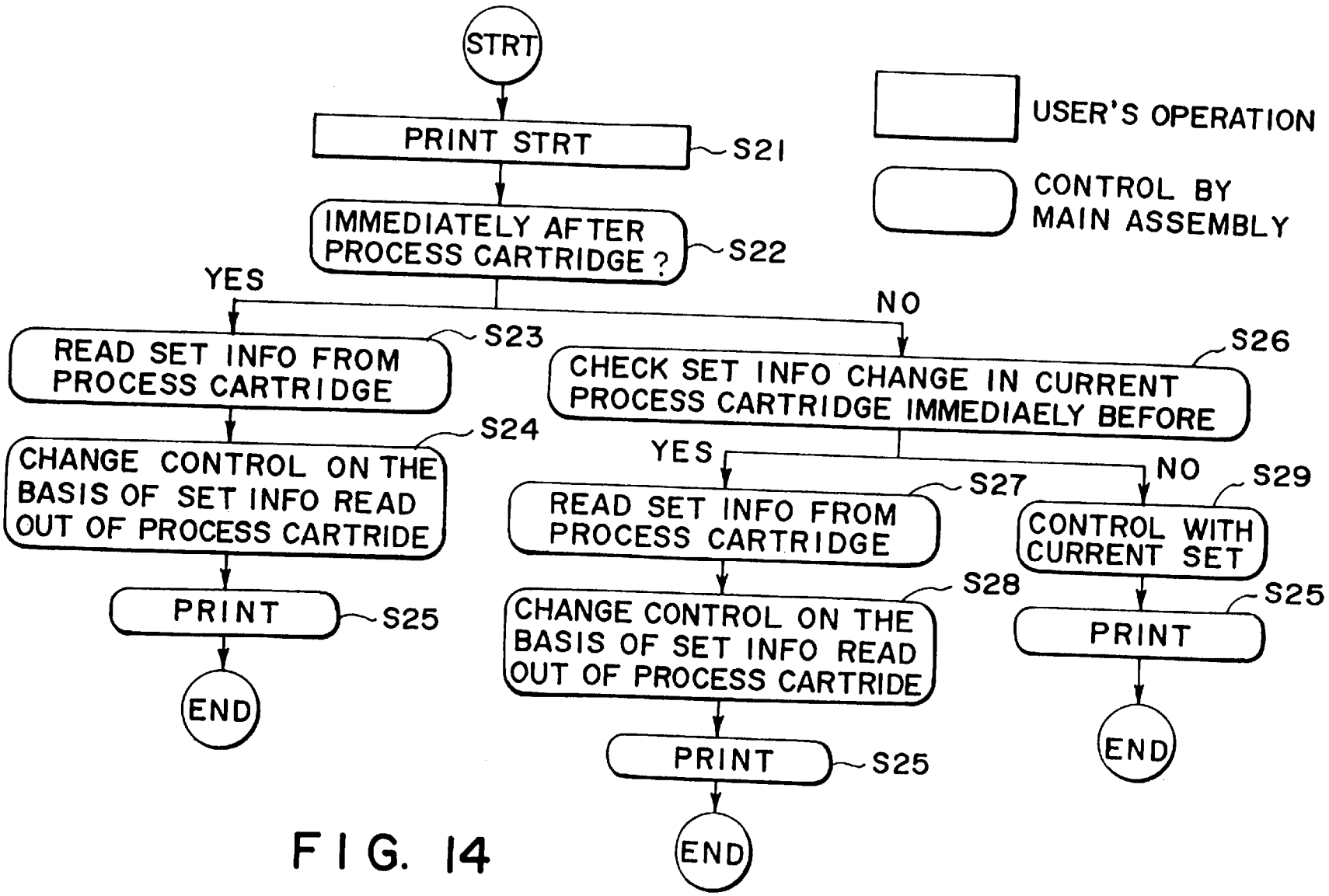
FIG. 14 is a flow chart depicting the flow of the control executed during the printing in the seventh embodiment.

As shown by the flow chart given in FIG. 14, these sets of control setting information are properly read out of the storage medium 18 of the process cartridge 14 each time a printing instruction is carried out.

Describing further the control setting changing process, with reference to the same flow chart, as a print start button is pressed (S21), a decision is made as to whether or not the process cartridge 14 has been just exchanged (S22). When it is determined that the process cartridge 14 has been just exchanged, control setting information is read out of the storage medium 18 of the process cartridge 14 (S23), and then, based on this control setting information, the control setting for the image forming apparatus is changed (S24). Thereafter, printing is started (S25).

On the other hand, when it is determined in step S22 that the process cartridge 14 has not been exchanged, a decision is made as to whether or not control setting information has been just changed in the same process cartridge (S26). When it is determined that changes have been made, the control setting information is read out of the storage medium of the process cartridge (S27), and the control setting of the image forming apparatus is changed on the basis of the control setting information read out of the storage medium of the process cartridge (S28). Thereafter, printing is started (S25). When it is determined in step S26 that the control setting information has not been just changed, the apparatus is controlled using the current control setting (S29). Thereafter, printing is started (S25).

Figure 12:
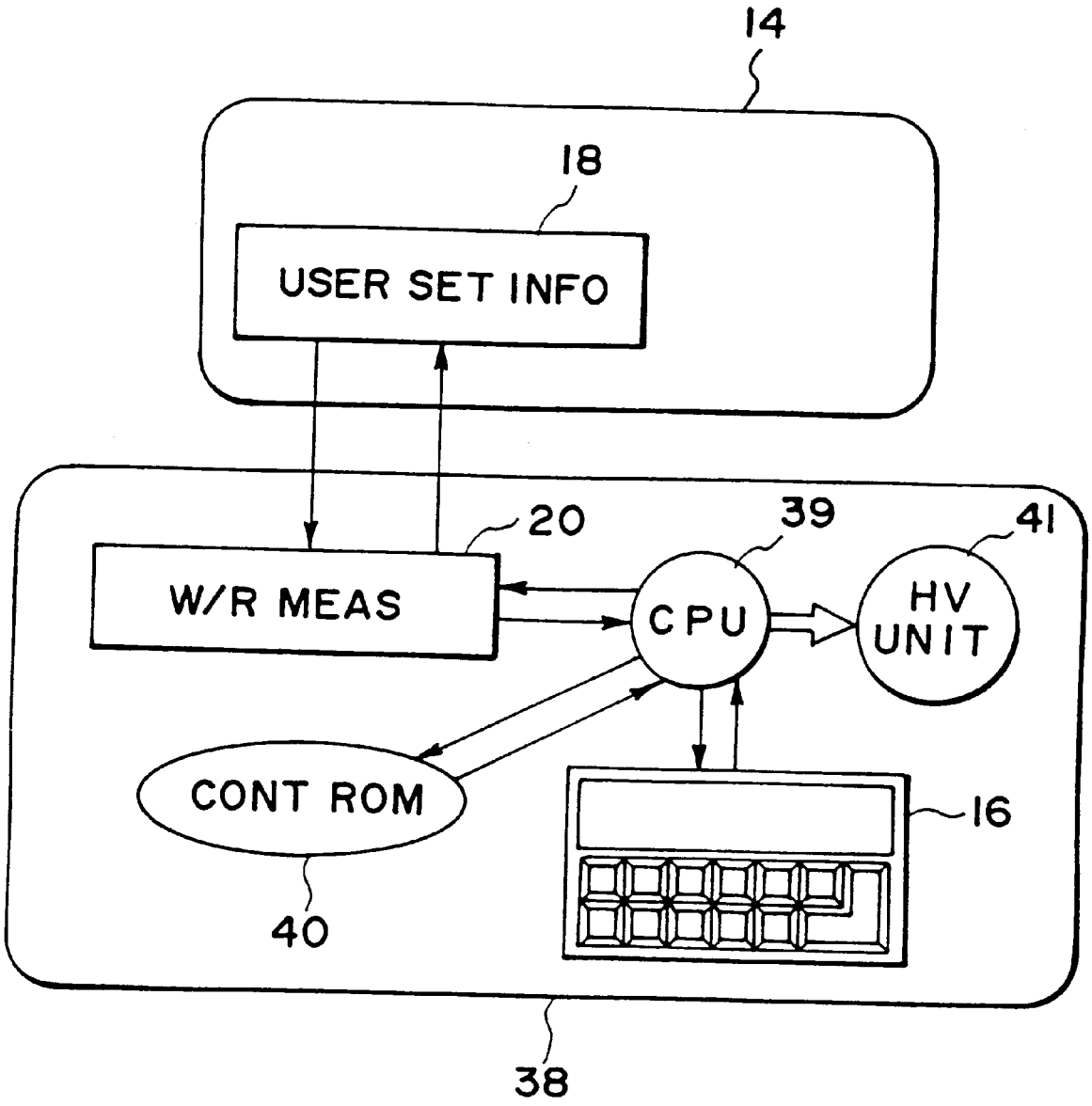
FIG. 12 is a block diagram depicting the controls in the seventh embodiment.
Figure 13:
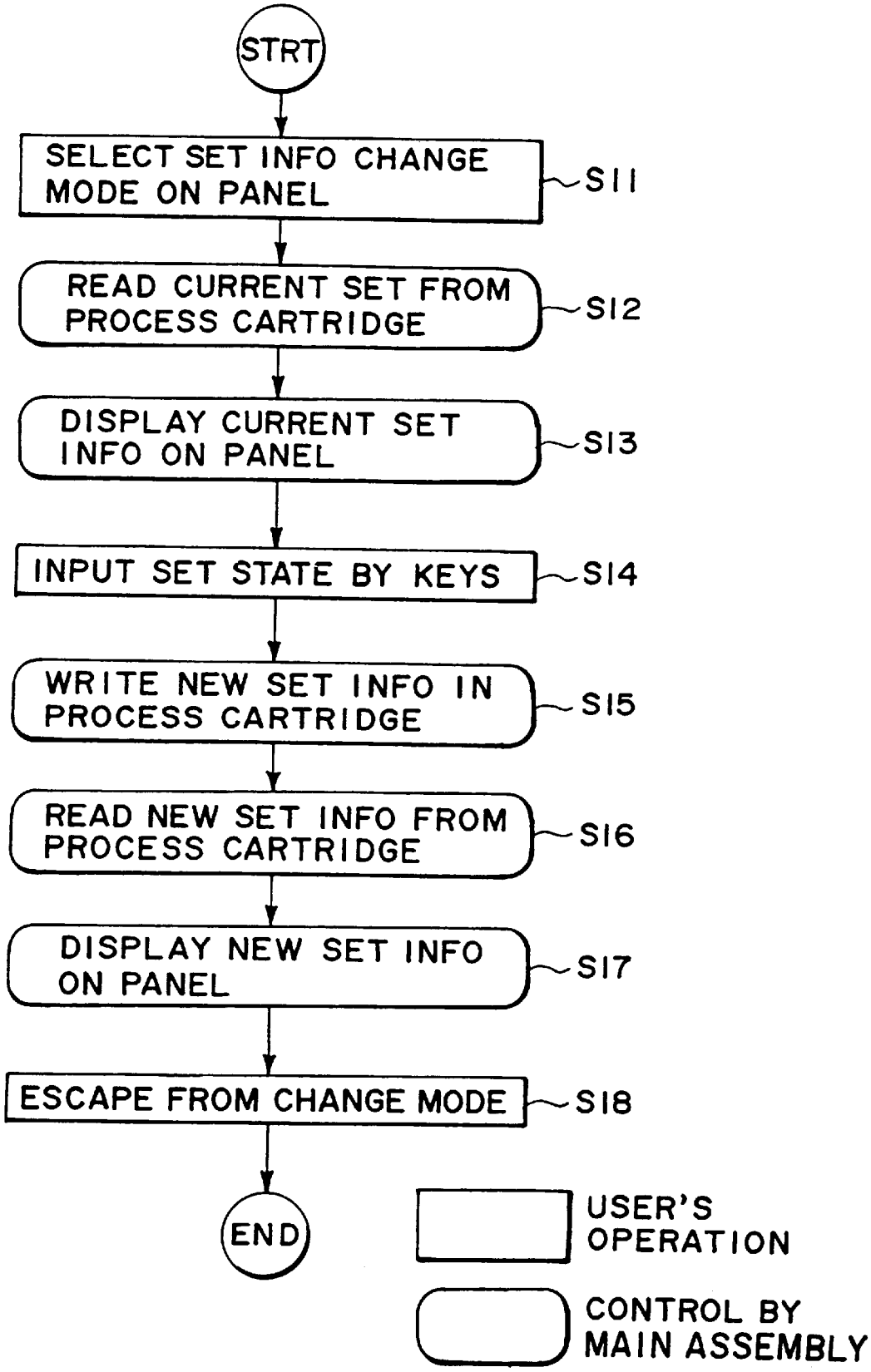
FIG. 13 is a flow chart depicting the control flow in the seventh embodiment.

For example, when a control setting is changed to decrease printing density, the control setting information stored in the storage medium 18 of the process cartridge 14 is read out through the control setting information writing/reading means 20 as shown in FIG. 12. Then, the CPU 39 queries the control information stored in an information control ROM 40 to look for the same control setting information as the control setting information read out of the storage medium 18 of the process cartridge 14, and then controls a high voltage unit 41 to adjust its output to a proper value, on the basis of the results of the query.

In the case of the image forming apparatus 38 in this embodiment, when the same image forming apparatus 38 is used by two or more users, when two for more process cartridges 14 are in use, and the image forming apparatus must be differently controlled or each process cartridge, or when in the like situations, the control setting can be changed by a simple operation, that is, simply by exchanging the process cartridge 14, since control setting information can be independently stored in advance in each process cartridge 14.

Also in the case of the image forming apparatus 38 of this embodiment, a method for representing the content of the control setting by the ON or OFF status of an imaginary DIP switch. In other words, the aforementioned control can be set simply by storing an array consisting of only 1s and 0s in the storage medium 18 of the process cartridge 14 Therefore, a storage medium which has a very small capacity and therefore a medium which is very inexpensive can be employed as the storage medium 18, making it possible to improve the aforementioned usability, while minimizing the cost increase of the process cartridge.

As is evident from the above description, according to the present invention, a user can give optional information, which is independent from the control information, such as the individual identification information, or management information for the apparatus main assembly, to the storage medium provided in a process cartridge or an image forming apparatus, and also can read out the optional information from the storage medium, or rewrite it. Therefore, it is possible to provide a process cartridge and a developing apparatus, which are superior in usability, and an electrophotographic image forming apparatus comprising such a process cartridge or a developing apparatus.

Further, according to the present invention, when a user gives optional information to the storage medium provided in a process cartridge or developing apparatus, a smooth operation is possible. Therefore, it is possible to provide a process cartridge and a developing apparatus, which are desirable in operability, and an electrophotographic image forming apparatus comprising such a process cartridge or a developing apparatus.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus for forming an image on a recording material, comprising:

first storing means for storing information; and a cartridge detachably mountable to a main assembly of the image forming apparatus, said cartridge comprising second storing means which is readable by the main assembly of the image forming apparatus when said cartridge is mounted to the main assembly of the image forming apparatus, wherein said first storing means stores information inputted by a user, and said second storing means stores an identification code which is assigned to the information stored by said first storing means, wherein the volume of data of the identification code is smaller than that of the information stored in said first storing means.

2. An image forming apparatus according to claim 1, further comprising a control panel for inputting the information inputted by the user.

3. An image forming apparatus according to claim 1, further comprising an image bearing member.

4. An image forming apparatus according to claim 3, wherein said image bearing member is an electrophotographic photosensitive member.

5. An image forming apparatus according to claim 3, further comprising at least one of charging means for charging said image bearing member, developing means for developing a latent image on said image bearing member, and cleaning means for cleaning said image bearing member.

6. An image forming apparatus according to claim 1, further comprising developing means for developing a latent image on an image bearing member.

7. An image forming apparatus according to claim 1, wherein said first and second storing means include a semiconductor memory.

8. A cartridge detachably mountable to a main assembly of an image forming apparatus, wherein the main assembly includes first storing means for storing information, wherein said cartridge comprises:

second storing means for storing an identification code which is assigned to the information stored in the first storing means, wherein the volume of data of the identification code is smaller than that of the information stored in said first storing means.

9. A cartridge according to claim 8, further comprising an image bearing member.

10. A cartridge according to claim 9, wherein said image bearing member is an electrophotographic photosensitive member.

11. A cartridge according to claim 9, further comprising at least one of charging means for charging said image bearing member, developing means for developing a latent image on said image bearing member, and cleaning means for cleaning said image bearing member.

12. A cartridge according to claim 8, further comprising developing means for developing a latent image on an image bearing member.

13. A cartridge according to claim 8, wherein said first and second storing means include a semiconductor memory.

* * * * *